US006125820A

United States Patent [19]

Hiraoka

[11] Patent Number: 6,125,820

[45] Date of Patent: Oct. 3, 2000

[54] THROTTLE CONTROL FOR OUTBOARD MOTOR

[75] Inventor: Noriyoshi Hiraoka, Hamamatsu, Japan

[73] Assignee: Sanshin Kogyo Kabushiki Kaisha, Hamamatsu, Japan

[21] Appl. No.: 09/286,765

[22] Filed: Apr. 6, 1999

[30] Foreign Application Priority Data

Apr. 7, 1998 [JP] Japan ..... 10-110118

[51] Int. Cl.[7] ..... F02D 9/08

[52] U.S. Cl. ..... 123/336; 123/184.53; 123/184.57

[58] Field of Search ..... 123/336, 184.24, 123/184.34, 184.53, 184.57

[56] References Cited

U.S. PATENT DOCUMENTS

| | | | |
|---|---|---|---|
| 4,539,947 | 9/1985 | Sawada et al. | 123/184.57 |
| 5,596,962 | 1/1997 | Tsunoda et al. | 123/184.53 |
| 5,628,287 | 5/1997 | Brackett et al. | 123/184.57 |
| 5,758,614 | 6/1998 | Choi | 123/184.53 |

FOREIGN PATENT DOCUMENTS

| | | | |
|---|---|---|---|
| 2 378 183 | 8/1978 | France | 123/184.57 |
| 59-49361 | 3/1984 | Japan | 123/184.57 |

*Primary Examiner*—Erick Solis

*Attorney, Agent, or Firm*—Knobbe, Martens, Olson & Bear LLP

[57] ABSTRACT

A silencing arrangement for the induction system of an internal combustion engine particularly as applied to an outboard motor. The engine silencing system includes at least one intake silencing valve that controls the emanation of sounds from the interior of the plenum chamber of the silencing device to the atmosphere. This valve position does not restrict airflow under the controlled positions. The valve can be positioned either in response to engine load as determined by factors such as throttle position or by engine speed.

15 Claims, 10 Drawing Sheets

THROTTLE CONTROL FOR OUTBOARD MOTOR

BACKGROUND OF THE INVENTION

This invention relates to a throttle control for an outboard motor and more particularly to an improved intake air silencing arrangement for an internal combustion engine such as is employed in an outboard motor.

As is generally well known, an outboard motor provides quite a number of design challenges for the engineer. Although the overall construction of an outboard motor is relatively simple and compact, because of this compactness there is very space little available for silencing of the induction system and exhaust noises associated with such outboard motors as well as the transmission of mechanical to the atmosphere through these systems. One area that provides particular difficulty is the transmission of noise from and/or through the induction system for the engine.

The induction system for an outboard motor must be designed so as to provide adequate air flow under a wide range of running conditions, particularly extended periods at full throttle. Also, the induction system should be designed in such a way as to inhibit the ingestion of water from the atmosphere into the engine through the induction system. Finally, it is important that the induction system be designed in such a way as to not generate significant noise that can be objectionable to the operator.

Therefore, it has been generally proposed to employ some form of silencing device in the intake system that includes one or more air inlet openings that deliver air to a plenum chamber and from there to the engine through the throttle bodies. Although various types of silencing arrangements have been proposed, they generally must be designed to be particularly effective at a certain speed and load range and also should be such that they do not restrict the airflow necessary to obtain maximum performance. Therefore, the conventional induction system is designed so as to primarily provide adequate air flow for high speed running. This results in considerable noise generation and transmission under other running conditions.

Although the induction system can be tuned to provide silencing at these other conditions, the tuning will restrict the airflow to the engine and hence, adversely effect maximum power output.

It is, therefore, a principal object of this invention to provide an improved induction system for an internal combustion engine and particularly one associated with an outboard motor.

It is a further object of this invention to provide an induction system that is capable of silencing induction system sounds and mechanical sounds transmitted through the induction system over a wide range of running conditions without restricting the necessary air flow to achieve the desired engine performance.

It if a further object of this invention to provide an improved air inlet device for an outboard motor.

SUMMARY OF THE INVENTION

This invention is adapted to be embodied in an induction system for an engine having at least one combustion chamber. The induction system includes a operator control throttle valve for controlling the volume of air flowing to the engine for controlling its speed. The induction system further includes an induction silencing device having an atmospheric air inlet and a control for controlling the flow through the inlet to effect silencing without restricting the amount of air flowing necessary to achieve the desired engine performance at the specific setting for the throttle valve.

DETAILED DESCRIPTION OF THE PREFERRED EMBODIMENTS OF THE INVENTION

Figure 3:
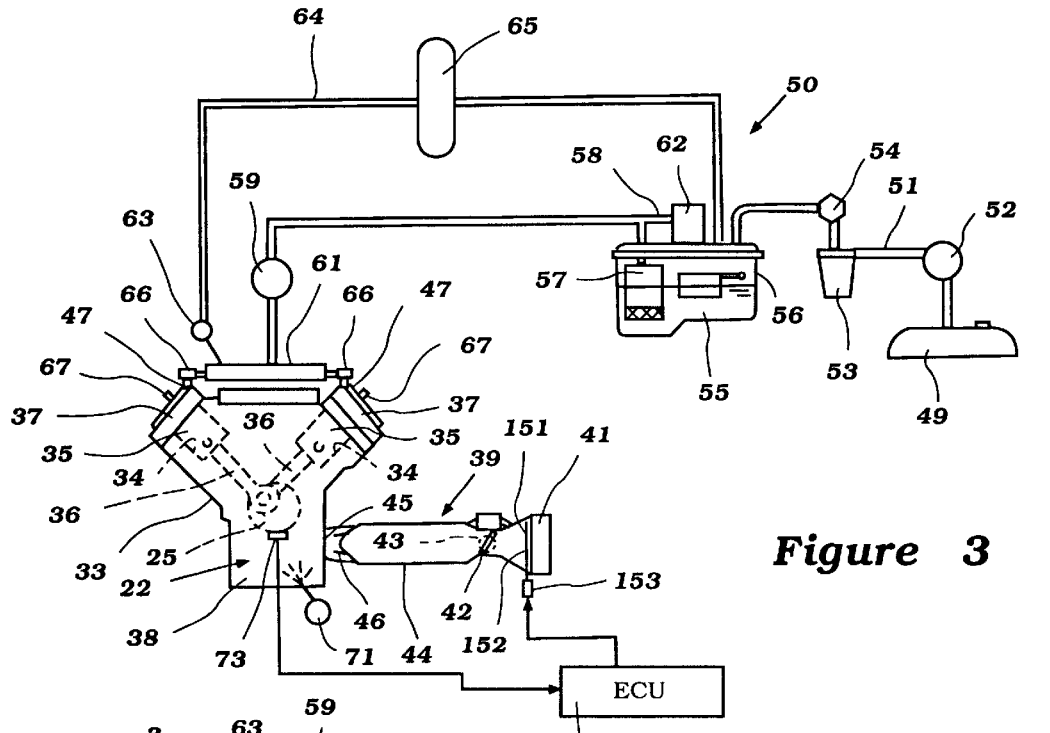
FIG. 3 is a schematic view of the engine including its induction, fuel charge forming and control systems, certain components of which are shown schematically.
Figure 2:
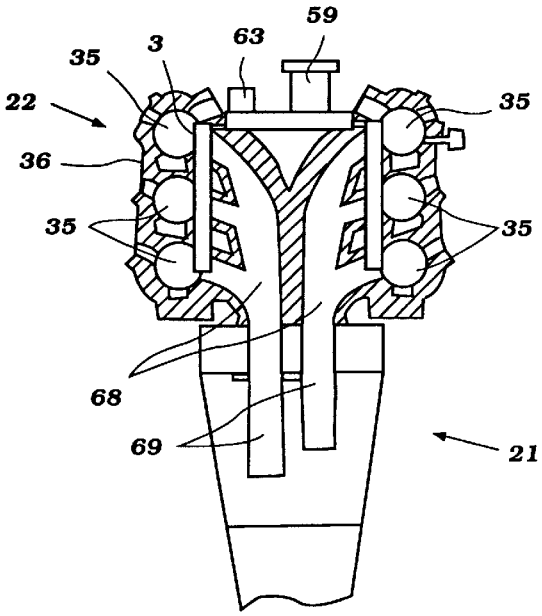
FIG. 2 is a rear elevational view showing the upper portion of the outboard motor with the protective cowling removed and portions broken away and shown in section.
Figure 1:
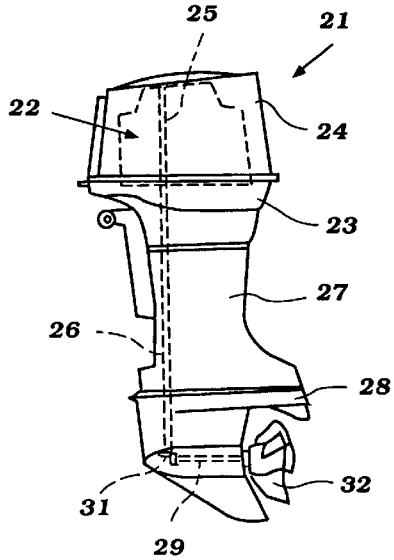
FIG. 1 is a reduced scale side elevational view of an outboard motor constructed in accordance with an embodiment of the invention.
Figure 4:
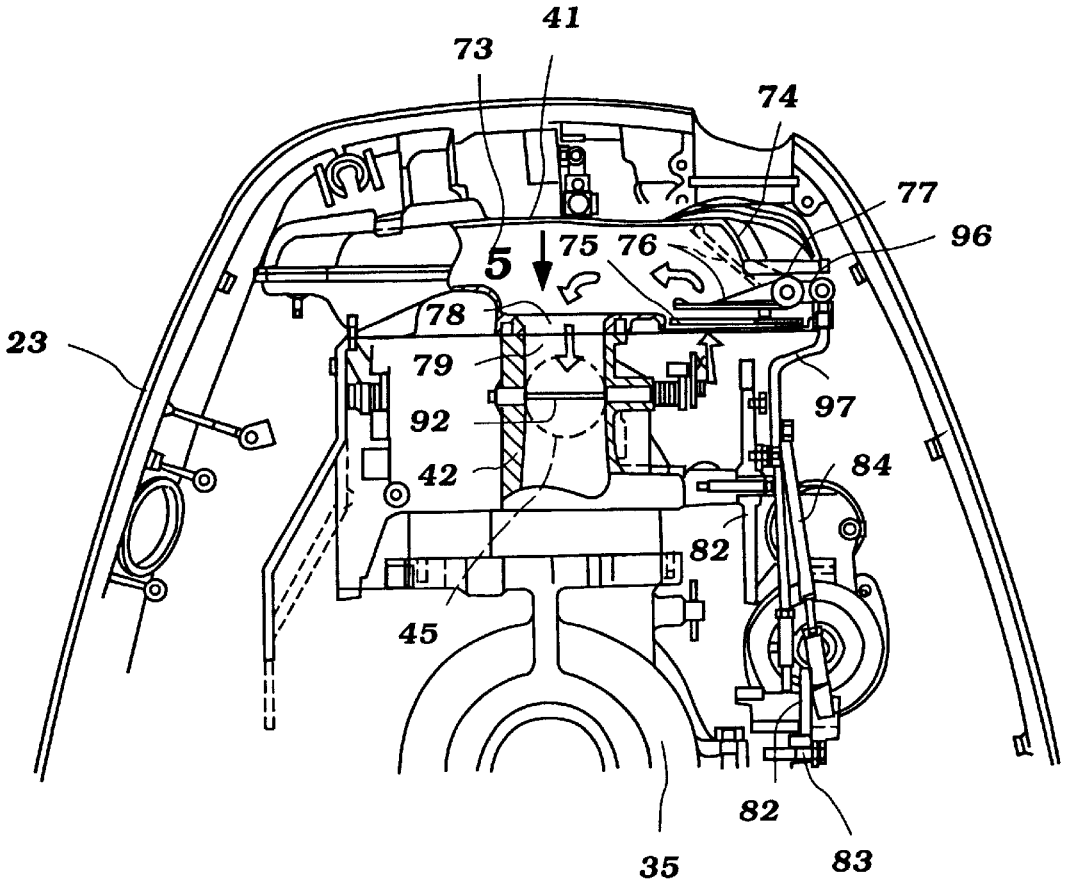
FIG. 4 is a top plan view of the powerhead looking generally in the same direction as FIG. 3 but showing only the air inlet device, which is shown partially in section, associated with the engine.
Figure 5:
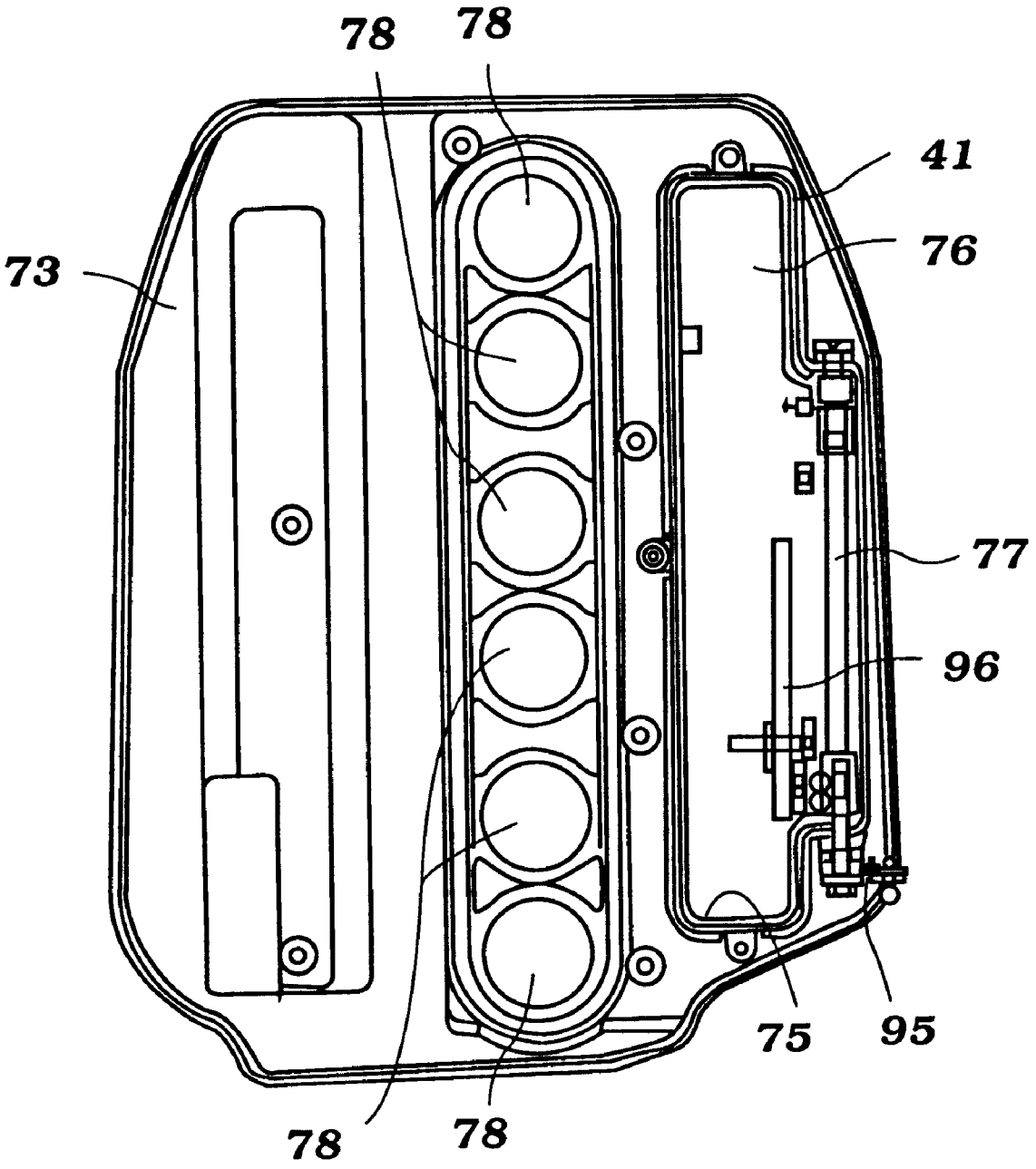
FIG. 5 is a view looking in the direction of the arrow 5 in FIG. 4 and shows the interior of the air inlet device and the throttle and silencing control valves.
Figure 6:
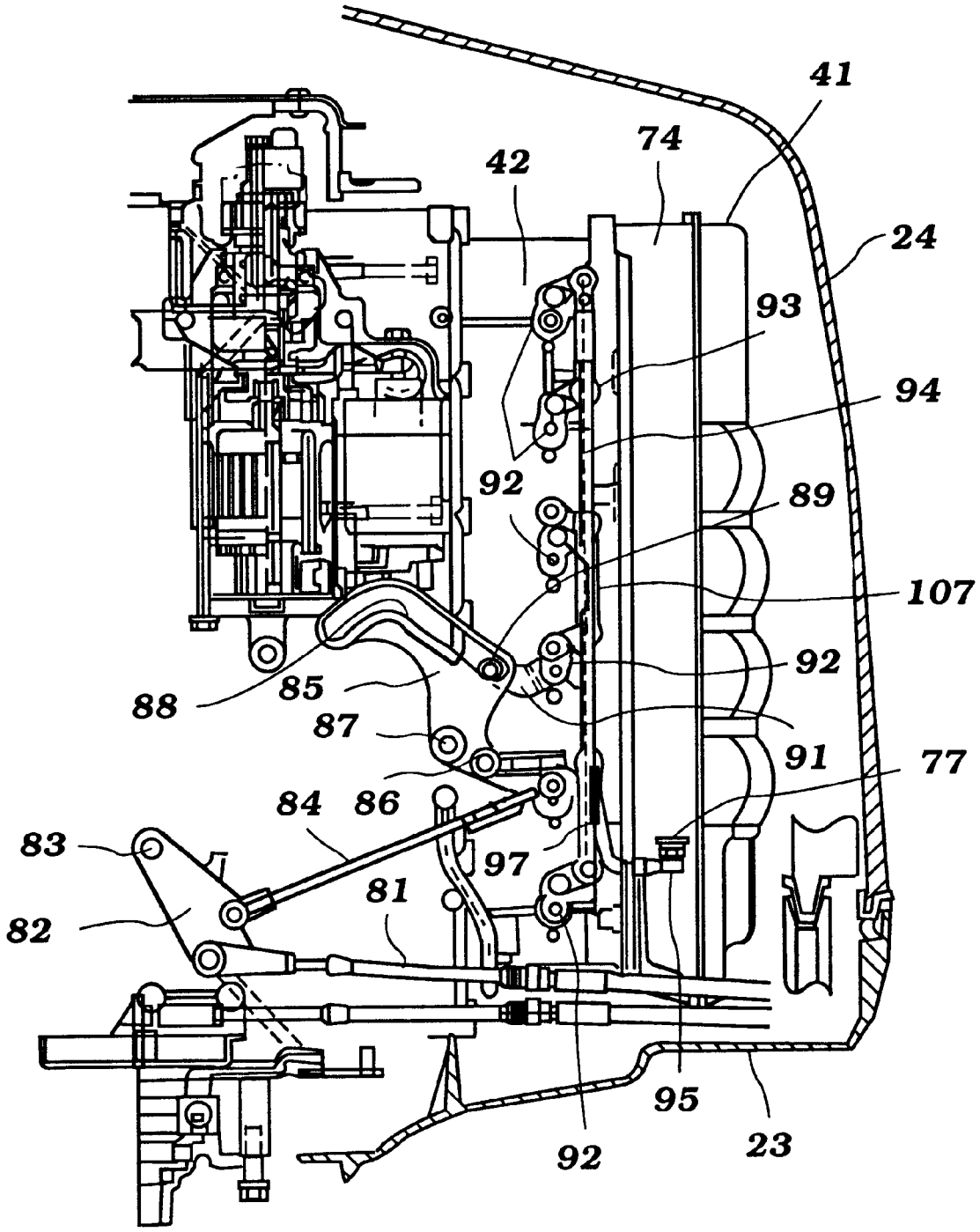
FIG. 6 is a side elevational view of the induction system in the powerhead with the protective cowling broken away and shown in section so as to show the control valve actuating system when operating at idle.
Figure 7:
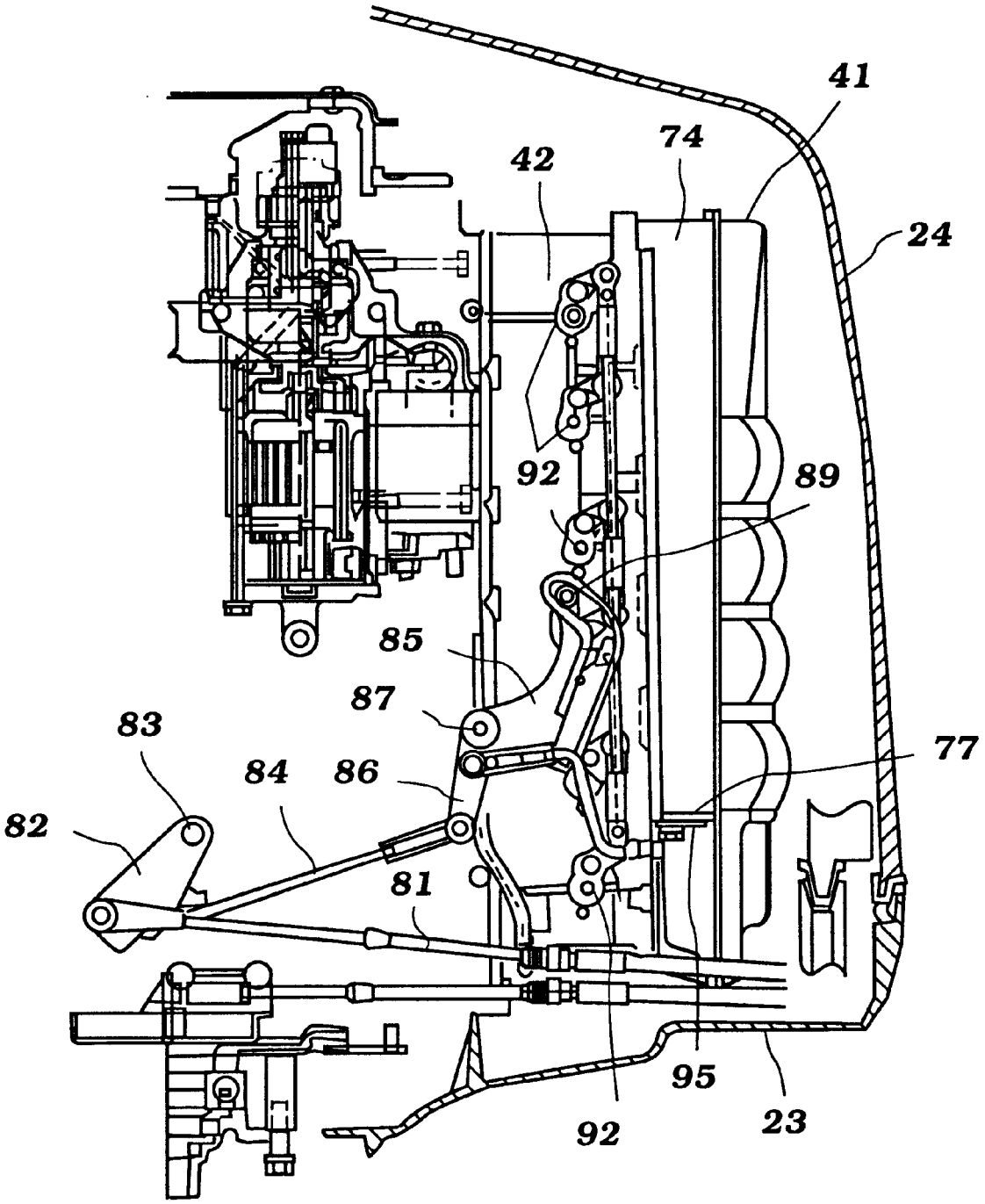
FIG. 7 is a view, in part similar to FIG. 6, but shows the condition when operating under wide open throttle.
Figure 8:
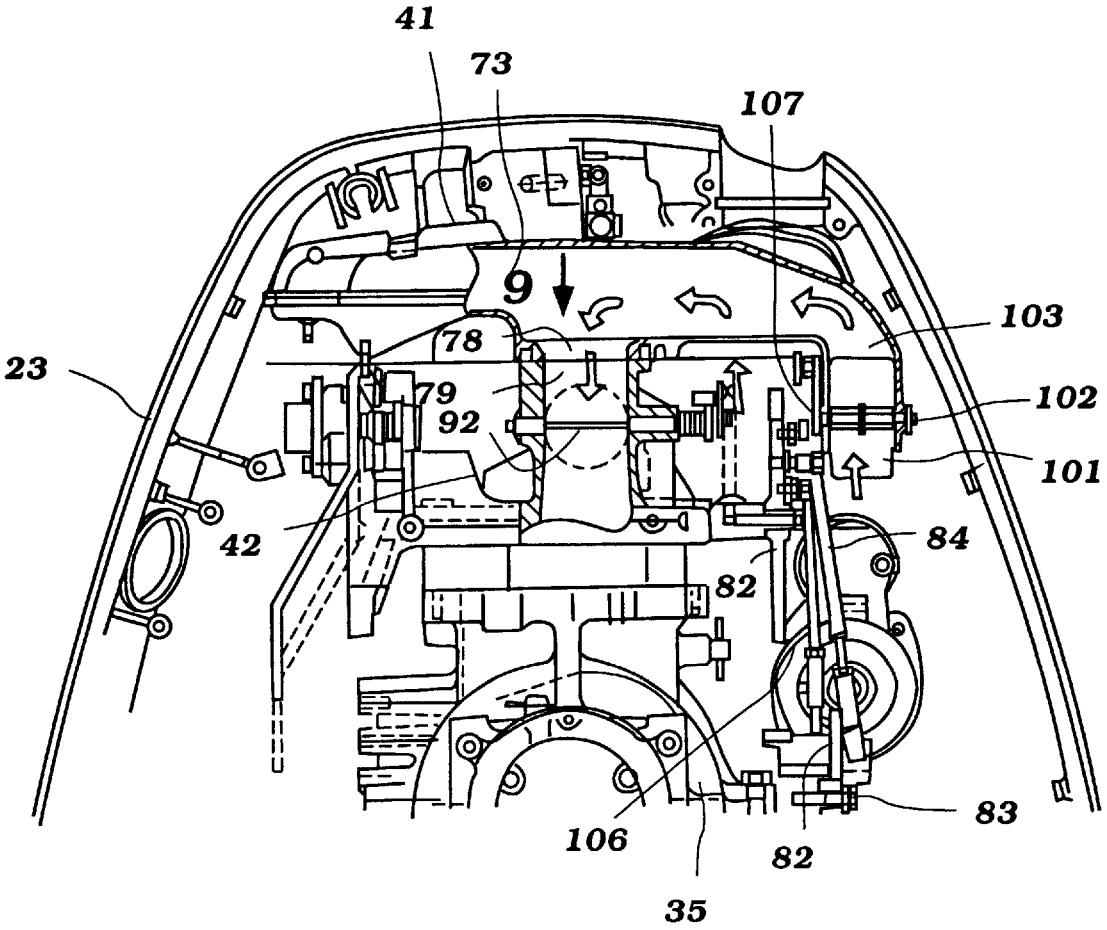
FIG. 8 is a view, in part similar to FIG. 4, showing another embodiment of the invention.
Figure 9:
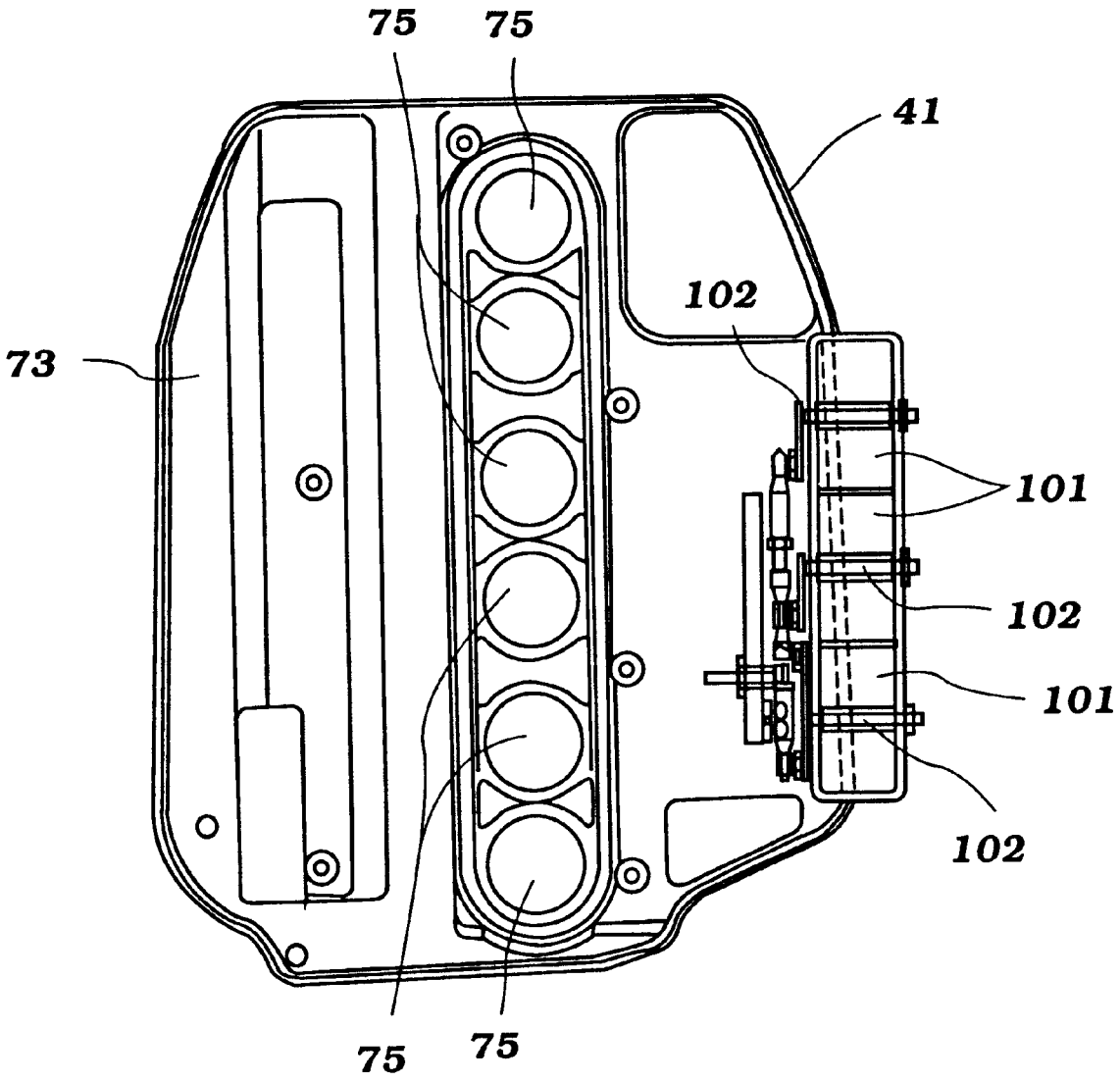
FIG. 9 is a view, in part similar to FIG. 5 but taken in the direction of the arrow 9 in FIG. 8.

Referring first to FIGS. 1–3, an outboard motor, indicated generally by the reference numeral 21, is illustrated which is a typical environment in which the invention has particular utility. As should be readily apparent from the foregoing description, the invention deals primarily with the induction system for the powering internal combustion engine of the outboard motor 21, which engine is indicated generally by the reference numeral 22.

However, in order to permit those skilled in the art to understand an environment in which the invention may be utilized, the construction of the outboard motor 21 will be described generally. It is to be understood, however, that where any details of the construction of the outboard motor 21 or individual internal details of the engine 22 are not illustrated or described, any known structure can be employed with which to practice the invention.

The outboard motor includes a powerhead that is comprised of the internal combustion engine 22 and a surrounding protective cowling comprised of a lower tray portion 23 and a detachably connected, main cowling portion 24. As is typical with outboard motor practice, the engine 22 is supported within this powerhead so that a crankshaft 25 of the engine 22 rotates about a vertically extending axis. This orientation is chosen so as to facilitate the establishment of a driving connection between the engine crankshaft 25 and a drive shaft 26 that depends into and is journaled within a driveshaft housing 27.

This drive shaft 26 continues on below the driveshaft housing 27 into a lower unit 28 where it drives a propeller shaft 29 through a conventional reversing type bevel gear transmission, indicated generally at 31. The propeller shaft 29 drives a suitable water propulsion system such as a propeller 32.

Not shown in FIG. 1 is the arrangement for attaching the outboard motor 21 to a transom of an associated watercraft. These structures are well known and can include a swivel bracket, steering shaft arrangement for facilitating steering of the outboard motor 21 and about a vertically extending axis for steering the associated watercraft. The swivel bracket is connected by a pivot pin to a clamping bracket for tilt and trim movement of the outboard motor 21, as is also known in the art. The clamping bracket is, in turn, affixed to the transom of the associated watercraft in any known manner.

In the illustrated embodiment, the engine 22 is depicted as being a V6 type engine operating on a two stroke crankcase compression principal. It will also be apparent to those skilled in the art, that the invention can be utilized with a wide variety of types of engine configurations and engines working on four stroke as well as two stroke principals.

As a V type engine, the engine 22 includes a cylinder block 33 having a pair of cylinder banks that are disposed at an angle to each other and each of which forms, in the specific embodiment, three vertically spaced cylinder bores 34. Pistons 35 are supported for reciprocation within these cylinder bores. The pistons 35 are, in turn, connected by means of connecting rods 36 to the throws of the crankshaft 25 for effecting its rotation in a manner well known in the art.

Cylinder head assemblies 37 are affixed to the cylinder banks of the cylinder block 36 and close the upper ends of the cylinder bores 34 in a well known manner. The cylinder head assemblies 37 cooperate with the cylinder bores 34 and pistons 35 to form the combustion chambers of the engine 22.

A crankcase member 38 is affixed to the cylinder block 36 and closes the lower ends of the cylinder bores and also forms crankcase chamber sections in which the crankshaft 25 is supported. Inasmuch as the engine 22 operates on a two cycle crankcase compression principal, the crankcase sections associated with each cylinder bore 34 are suitable sealed from each other.

An induction system, embodying the invention and indicated generally by the reference numeral 39, is provided for delivering an air charge to these crankcase chamber sections. This induction system includes an intake device, indicated generally by the reference numeral 41 and which has a structure associated with it for affecting variable silencing effects that will be described in more detail later by reference to the more specific figures of the respective embodiments.

This induction system and silencing device 41 delivers the silenced air to throttle bodies 42 in which flow controlling throttle valves 43 are positioned. These throttle valves 43 are controlled in an appropriate manner in response to engine demand for providing the actual speed control for the engine, as will be described later.

The throttle bodies 42, in turn, deliver air to manifold runner sections 44 of an intake manifold. These intake manifold runners 44 deliver the inducted air to the crankcase chamber sections through intake ports 45.

As is typical with two cycle engine practice, reed type check valves 46 are provided at the ends of the runner sections 44 so as to permit the intake charge to be drawn into the crankcase chambers when the respective piston 35 is moving upwardly in its cylinder bore 34. As the piston 35 moves downwardly, however, the check valves 46 will close to preclude reverse flow. The charge is then compressed in the crankcase chamber sections.

Again and is typical with two cycle engine practice, the compressed charge is transferred from the crankcase chamber sections to the combustion chambers through a suitable scavenging system which is not illustrated and which is not necessary to permit those skilled in the art to understand the invention. This air charge is then further compressed in the combustion chambers as the pistons 35 continue their upward stroke in the cylinder bores 34.

A fuel charge is delivered to these combustion chambers in the specific illustrated embodiment by individual fuel injectors 47 that are mounted in the cylinder head assemblies 37 and which spray directly into the combustion chambers. Although the invention is described with respect to such a specific type of charge forming system, consistent with the other features of the invention which, as has been noted several times, relates primarily to the air inlet device 41, other types of charge forming systems can be employed.

A fuel supply system, indicated generally by the reference numeral 50 and shown in most detail in FIG. 3, is provided for supplying fuel to the fuel injectors 48 at high pressure. This fuel supply system 50 includes, as is typical with outboard motor practice, a main fuel storage tank 49 that is provided in the hull of the associated watercraft. A conduit 51 in which a priming pump 52 is provided for delivering this fuel to the interior of the protective cowling of the powerhead.

The conduit 51 terminates in a fuel filter 53 that is mounted within the main cowling member 24 for ease of servicing. Low pressure pumps 54 pump the fuel from the tank 49 to a vapor separator, indicated by the reference numeral 55. The pumps 54 may be operated, for example, by utilizing pressure variations within the crankcase chambers as is known in the art.

The vapor separator 55 maintains fuel at a predetermined level by means of a float operated valve 56 and provides a venting system for venting vapors to the atmosphere either directly or through the induction system of the engine.

Positioned within the vapor separator 55 is a high pressure electric fuel pump 57 that is operated to pump fuel to a fuel delivery conduit 58. A mechanically driven high pressure pump 59 is mounted at the termination of the line 58 and supplies fuel under high pressure to a main fuel manifold 61. The high pressure pump 59 may be driven off of the crankshaft 25 of the engine 22 in any suitable manner.

A low pressure regulator 62 is provided in the line 58 and controls the pressure of the fuel supply to the high pressure pump 59. As is typical, this is done by dumping excess fuel back to the vapor separator 55.

The output of the high pressure pump 59 is regulated by a high pressure regulator 63 which again regulates pressure by bypassing fuel back to the vapor separator 55. This is done through a return line 64 in which a fuel cooler 65 is positioned.

The main fuel manifold 61 is connected to a pair of fuel rails 66 each of which serves the fuel injectors 47 of the respective cylinder bank in a known manner.

Spark plugs 67 are mounted in the cylinder head assemblies 37 for firing the charge which has been formed in the combustion chambers by the air induction system 39 and fuel charging system 48. This charge is then exhausted through exhaust manifolds 68 (FIG. 2) that are formed in the cylinder block 36 and which communicate with exhaust pipes 69 that communicate with a suitable exhaust system formed within the driveshaft housing 27. This can include both below the water high speed exhaust gas discharges and above the water low speed exhaust gas discharges.

The structure as heretofore described may be considered to be conventional and, as has been previously noted, where any details have not been illustrated or described, those skilled in the art can readily resort to known structures for practicing the invention.

Before moving on to this, however, certain additional description will be made by primary reference to FIGS. 1–3. As seen in FIG. 3, the engine may be provided with a lubricating system, including a lubricant pump 71 that sprays oil to the engine through the crankcase chamber sections or which delivers it directly. There also is provided an ECU 72 that controls the timing and duration of fuel injection from the fuel injectors 47 in accordance with any desired strategy as well as the firing of the spark plugs 67.

Various sensors are employed for this control and these include a crank angle sensor 73 that is associated with the crankshaft 25. In addition to providing a signal of crank angle, the sensor 73 also can give a speed indication by measuring change in crank angle in accordance with time. This may be used for control of the silencing system which will now be described in accordance with the first embodiment of the invention by reference to FIGS. 4–7. These figures show an air inlet device, indicated previously by the reference numeral 41 which has a plenum chamber 73 that receives air from an intake system that is formed at one side 74 of the device 41 and which has an inlet opening 75 which may be generally rectangular in configuration and which faces toward the crankcase member 38.

This opening 75 draws air from within the protective cowling for ingestion into the engine. A flap type silencing control valve 76 is mounted on a support shaft 77 at one side of the opening 75 and is operated by means of a linkage system, to be described, for controlling the effective flow area of the opening 75 and, accordingly, the silencing effect thereof. The manner with which this is done will be described shortly. From the plenum chamber 75, air is then delivered to the throttle bodies through outlet openings 78 formed in the body of the inlet device 41 and which register with flow passages 79 of the throttle bodies 42 upstream of the throttle valves 43.

In this embodiment, the silencing valve 76 functions not to restrict the amount of air flowing into the engine but rather the effective size of the opening 75 to provide a silencing effect. This can be chosen in accordance with known acoustical principles. In addition, by restricting the open area, engine mechanical noises can be precluded from escaping.

One way this can be done is by positioning the silencing control valve 76 at a position that is related to but not totally linearly with the opening of the throttle valves 43. This is done by the linkage system that appears best in FIGS. 6 and 7, although portions of it appear in the other figures.

The basic throttle control for the engine 22 is done by means of a throttle control boden wire actuator 81 that extends outwardly from the protective cowling and is connected to a suitable throttle control such as a twist grip throttle control. This boden wire cable 81 is affixed to an end of a bell crank 82 that is pivoted on the cylinder block 36 by means of a pivot pin 83.

One end of a throttle control link 84 is pivotally connected to the bell crank 82. The other end of the throttle control link 84 is connected to a timing link 85 and specifically an extending arm thereof 86. This timing link 85 is also journaled on the cylinder block 36, in this case by means of a pivot pin 87.

The throttle control link 84 has a cam groove 88 in which the follower pin 89 of a throttle lever 91 is captured. The throttle lover 91 is affixed to the throttle valve shaft 92 of one of the throttle bodies 42. The remaining throttle valve shafts 92 of the remaining throttle bodies have follower links 93 that are connected to a synchronizing link 94 so that all of the throttle valves will open uniformly and simultaneously.

The air silencing control valve 76 and specifically its shaft 77 has a control link 95 affixed to it. This control link 95 is also connected to a bracket arm 96 that extends along one side of the silencing control valve 76 so as to provide smooth motion.

A silencing control valve link 97 is connected at one end to the throttle control link 95 and at the other end to the control valve link 95. Thus, as the throttle control lever 85 is rotated, both the throttle valves 43 and the silencing control valve 76 will be progressively opened. By varying the length of the pivot points and the shape of the slot 88, the desired relationship between openings can be established to provide the desired silencing effect at each throttle opening.

Basically, when the throttle valves 43 are relatively closed, the silencing control valve 76 will be relatively closed. Also, when the throttle valves 43 are open, the silencing control valve 76 will be opened. The valve 76 does not restrict the air flow but does restrict the emanation of sound from the interior of the plenum chamber 73 to the atmosphere.

In the embodiment as thus far described, the air silencing control valve 76 has comprised a single valve supported for pivotal movement on a shaft that extends transversely to the throttle valve shafts 92.

FIGS. 8–12 show another embodiment of the invention wherein there are a greater number of silencing control valves, each indicated generally by the reference numeral 101. Each of the silencing control valves 101 is mounted on a respective control valve shaft 102 that is parallel to the throttle valve shafts 93. These silencing control valves 101 each cooperate with a respective one of three vertically spaced air inlet passages 103.

The actuating mechanism is substantially the same for the throttle valves 42, 43 of this embodiment however, the actuating mechanism for the silencing control valves 101 is different because of their different orientation and number.

Figure 10:
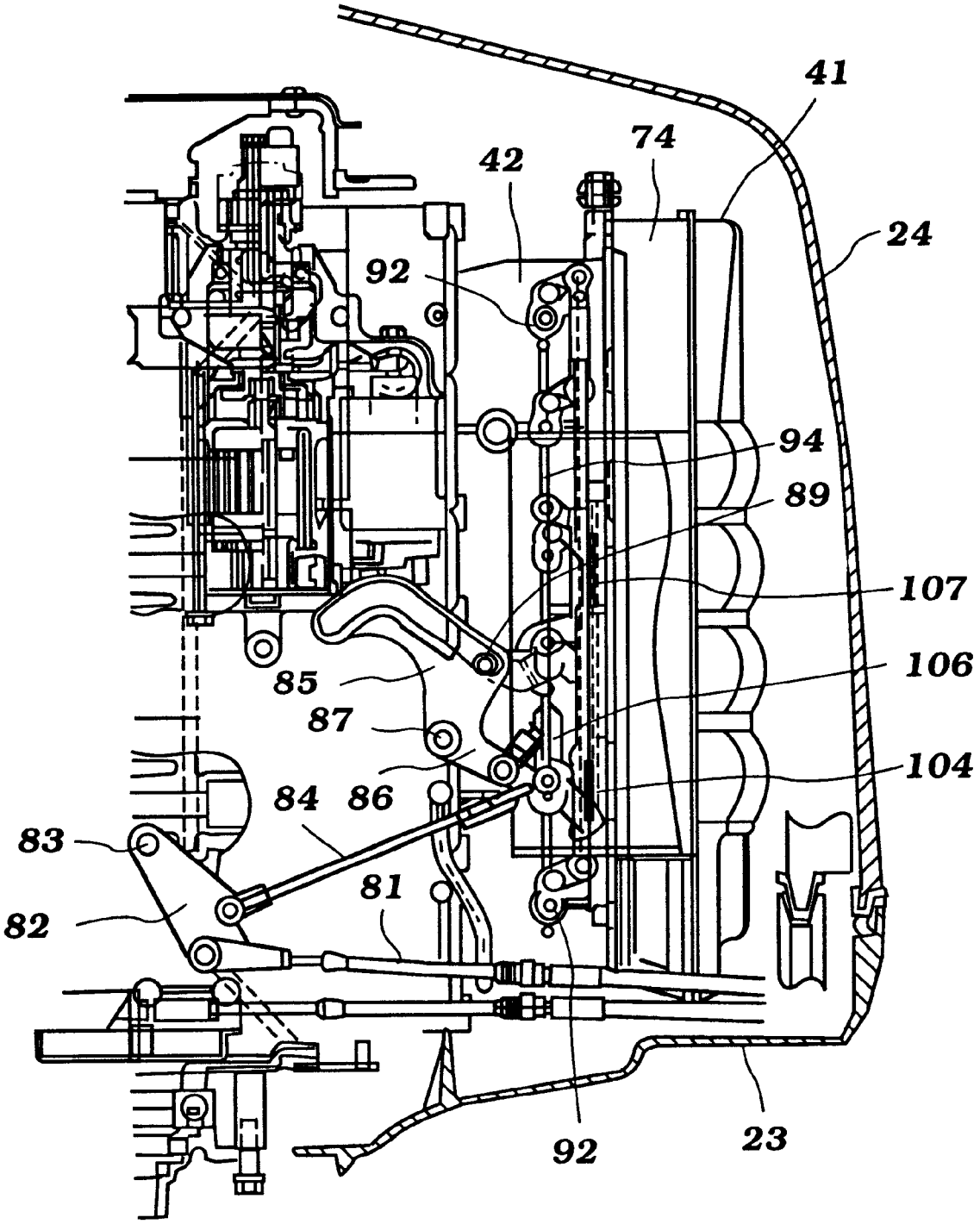
FIG. 10 is a side elevational view of this embodiment, in part similar to FIG. 6, and shows the position of the throttle control at idle.
Figure 11:
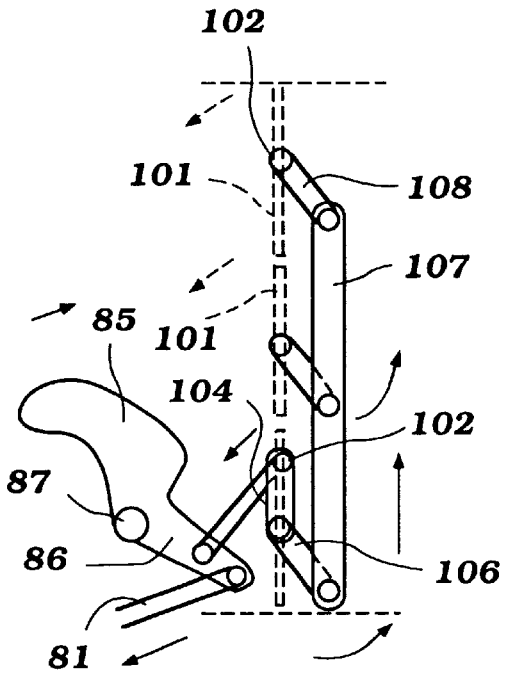
FIG. 11 is a simplified view looking generally in the same direction as FIG. 10 with the throttle in the same position but showing more details of throttle control linkage at idle operation.
Figure 12:
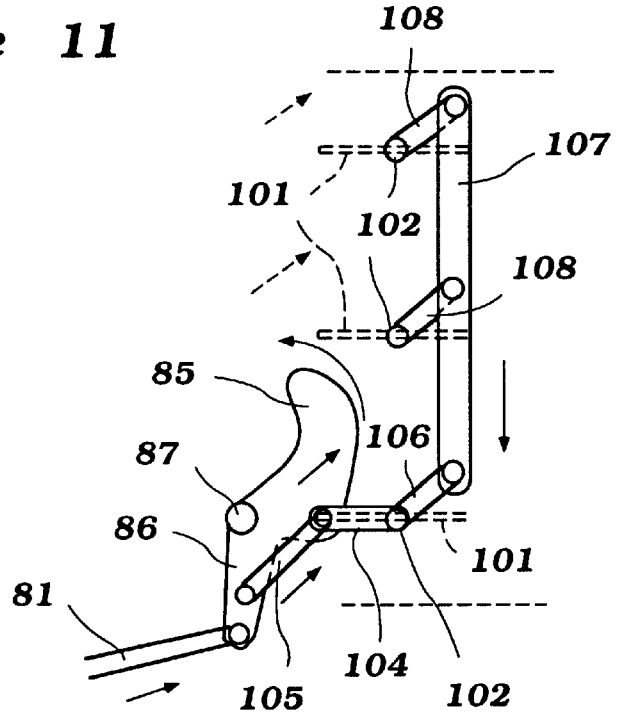
FIG. 12 is a view, in part similar to FIG. 11 and shows the mechanism in the wide open throttle condition.

This mechanism appears best in FIGS. 10–12 and includes a silencing control valve link 104 that is fixed to the control valve shaft 102 of the lowermost silencing control valve 101. The opposite end of the link 104 is connected to a control link 105 which is, in turn, pivotally connected to the throttle control link 85. A synchronizing link 106 connects the silencing control valve shaft 102 of the lowermost silencing control valve with a synchronizing link 107.

The remaining control valve shafts 102 have follower links 108 that are connected at one end to the shafts 102 and are pivotally connected at their other end to the synchronizing link 107. Hence, these control valves 101 will all be moved in synchronism from their closed, maximum silencing position as shown in FIG. 11 to their open minimum silencing position in FIG. 12. Again, the configuration of the linkage can be chosen so as to provide the desired timing strategy.

Figure 13:
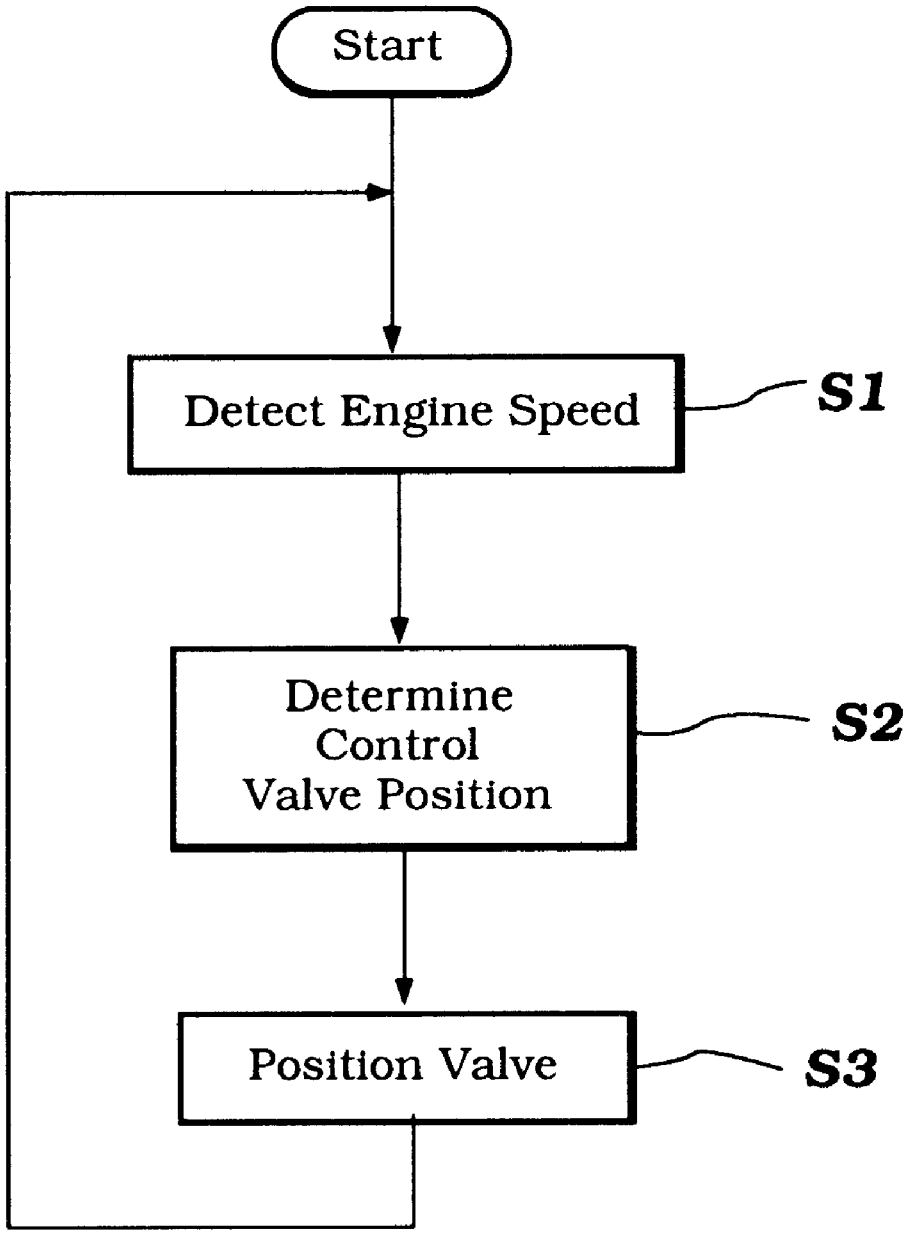
FIG. 13 is a block diagram showing generally the control routine for achieving automatic control of the induction control valves without utilizing a linkage system.

As was noted in the discussion of FIGS. 1–3, it also possible to utilize the ECU 72 for the direct control of the silencing control valves. FIG. 13 shows a potential control routine for doing this and FIG. 3 shows a schematic system wherein a control valve 151 is supported on a control valve shaft 152 which is, in turn, angularity positioned by a stepping servo motor 153. In this embodiment, rather than using throttle valve position or load, the position of the silencing control valves 105 is controlled in response to engine speed.

Hence, and referring to the control routine of FIG. 13, the programs and moves to the step S1 to detect engine speed. This is done by utilizing the crank angle sensor 73 to determine speed as previously mentioned. The program then goes to the step S2 to read the desired or optimum silencing angle for the silencing control valve 151 in response to this speed. The program then moves to the step S3 so as to actuate the servo motor 153 to place the valve in its appropriate position.

As with the previously described embodiments, the silencing valves will be moved generally in proportion to the throttle valves or speed so that they will be held in closed positions at low speeds and fully opened at maximum speed. Of course, the results need not be linear.

Thus, from the foregoing description it should be readily apparent that the described construction is effective in providing a very good induction system for engines and particularly outboard motor wherein the silencing can be adjusted in response to various parameters so as to provide different degrees of silencing at different speeds without restricting the air flow to the engine or the maximum possible obtainable power of the engine. Of course, the foregoing description is that of preferred embodiments of the invention. Various changes and modifications may be made without departing from the sprit and scope of the invention, as defined by the appended claims.

What is claimed is:

1. An induction system for an engine having at least one combustion chamber, said induction system includes a operator control throttle valve for controlling the volume of air flowing to said engine for controlling its speed, an induction silencing device having an atmospheric air inlet opening communicating directly with an atmospheric air source and a control for controlling the flow through said atmospheric air inlet opening by varying the effective flow area of said atmospheric air inlet opening to effect silencing without restricting the amount of air flowing necessary to achieve the desired engine performance at the specific setting for said throttle valve.

2. An induction system for an engine as set forth in claim 1 wherein the induction silencing device is adjusted in response to engine load.

3. An induction system for an engine as set forth in claim 1 wherein the induction silencing device is adjusted in response to operator demand.

4. An induction system for an engine as set forth in claim 1 wherein the induction silencing device is adjusted in response to engine speed.

5. An induction system for an engine as set forth in claim 1 wherein the induction silencing device comprises a plenum chamber device having a predetermined volume.

6. An induction system for an engine as set forth in claim 5 wherein the flow through the atmospheric air inlet is controlled by a pivotally supported flow control member effective to obstruct at least a portion of said atmospheric air inlet.

7. An induction system for an engine as set forth in claim 6 wherein the throttle valve comprises a butterfly type valve rotatable about an axis normal to the axis of the flow control member.

8. An induction system for an engine as set forth in claim 6 wherein the throttle valve comprises a butterfly type valve rotatable about an axis parallel to the axis of the flow control member.

9. An induction system for an engine having a number of combustion chambers and induction silencing device has a plurality of outlets each serving a respective operator control throttle valve for controlling the volume of air flowing to said engine combustion chambers for controlling its speed, each of said operator control throttle valves comprises butterfly type valves operated by a synchronizing throttle control linkage system and an induction silencing device having an atmospheric air inlet and a control for controlling the flow through said inlet to effect silencing without restricting the amount of air flowing necessary to achieve the desired engine performance at the specific setting for said operator control throttle valves comprising a pivotally supported flow control member effective to obstruct at least a portion of said atmospheric air inlet.

10. An induction system for an engine as set forth in claim 9 wherein the flow control member is adjusted in response to engine load.

11. An induction system for an engine as set forth in claim 10 wherein the flow control member is adjusted by a linkage system operated through the synchronizing throttle control linkage system.

12. An induction system for an engine as set forth in claim 9 wherein the flow control member is adjusted in response to operator demand.

13. An induction system for an engine as set forth in claim 12 wherein the flow control member is adjusted by a linkage system operated through the synchronizing throttle control linkage system.

14. An induction system for an engine as set forth in claim 9 wherein the flow control member is adjusted in response to engine speed.

15. An induction system for an engine as set forth in claim 14 wherein the flow control member is adjusted by a servo motor.

* * * * *